United States Patent [19]

Spridco

[11] Patent Number: 4,466,525

[45] Date of Patent: Aug. 21, 1984

[54] MARINE PROPULSION CONTROL SYSTEM FOR LOW SPEED MANEUVERING

[75] Inventor: Dale R. Spridco, Milwaukee, Wis.

[73] Assignee: The Falk Corporation, Milwaukee, Wis.

[21] Appl. No.: 339,847

[22] Filed: Jan. 18, 1982

[51] Int. Cl.[3] ..... B60K 41/02

[52] U.S. Cl. ..... 192/0.076; 192/0.096

[58] Field of Search ..... 192/0.096, 0.098, 0.048, 192/0.07, 0.075, 0.076, 3.57, 109 F, 87.18, 87.19

[56] References Cited

U.S. PATENT DOCUMENTS 3,727,737 4/1973 Phinney ..... 192/0.098

4,072,221 2/1978 Phinney ..... 192/0.098

*Primary Examiner*—George H. Krizmanich

*Attorney, Agent, or Firm*—Quarles & Brady

[57] ABSTRACT

A control system for a marine drive is shown which controls the inflation of ahead and astern clutches and an engine speed governor. Upon actuation of a throttle lever controlling a throttle valve, a selector valve is first actuated to operatively connect one or the other of the clutches to the control. Further movement of the throttle lever causes a relay valve to supply air at a pressure proportional to the throttle position to a main control valve which passes such air pressure to the selected clutch until a first control pressure is reached. Thereafter, air from the supply is supplied at a programmed rate to the selected clutch to continue inflation of the clutch until a second clutch pressure is reached whereupon a boost valve is actuated to connect full supply air pressure to the selected clutch. When the throttle lever is moved to a position commanding low speed, a maneuvering valve pilots the boost valve so that full supply air pressure is connected through the boost valve and the main valve to the selected clutch. The maneuvering valve is rendered inoperative when a sudden increase from zero speed to a high speed is required or if a crash reversal of direction is commanded.

5 Claims, 2 Drawing Figures

MARINE PROPULSION CONTROL SYSTEM FOR LOW SPEED MANEUVERING

BACKGROUND OF THE INVENTION

This invention relates to ship propulsion systems, and more particularly to an improved propulsion system control which provides a more rapid response when the ship is maneuvering at low vessel speeds.

A common form of marine propulsion system uses ahead and astern air actuated clutches for connecting the prime mover to a reversing reduction gear unit which drives the propeller. The air actuated clutches are engaged by inflation and the degree of clutch engagement can be controlled by controlling the amount of inflation. A pneumatic control system is typically provided for selecting the ahead or astern clutches, for controlling the clutch inflation, and for controlling an engine speed governor which determines the engine speed. A single throttle lever apparatus can be provided for controlling both the clutch engagement and engine speed by movement of the lever from neutral towards either an ahead or astern direction. Examples of such a control for a ship's propulsion system is found in U.S. Pat. No. 3,727,737 of John M. Phinney, issued Apr. 17, 1973 for "Pressure Modulating System for reversing Clutches and Throttle Control" and U.S. Pat. No. 4,072,221 issued Feb. 7, 1978 for "Marine Clutch and Throttle Governor Control System."

In the systems of these earlier patents, a pneumatic clutch control assembly for a ship's propulsion system is sequentially operated to regulate the inflation of ahead and astern air infatable clutches and to also control the prime mover speed. The control assembly is actuated by a single throttle lever located on a pilot house control stand. Movement of the lever in one direction provides forward rotation of a propeller at a speed which increases with handle travel away from neutral. Movement of the handle in the opposite direction provides astern rotation of the propeller with speed increasing as the handle is moved farther from neutral. The center position provided a neutral setting in which the engine is disconnected from the propeller and no power is transmitted, although the engine continues to idle.

The single lever control of both direction and speed is accomplished in the following manner: As the lever is pivoted in either direction from neutral, air is supplied to a selector valve which selects one or the other of the ahead or astern clutches. Thereafter, and up to a first control pressure, air pressure proportional to the position of the lever away from neutral is fed through a first valve to the selected clutch and begins inflating the selected clutch. During this time the engine remains at idle speed. After a first control pressure is reached, the first valve is piloted and a second path for air to the clutch is established. This second path has provision for an initial programmed rate of feed of air to the clutch through a choke valve so as to softly inflate the clutch. Upon reaching a second higher control pressure, full supply air pressure is connected to the clutch. After the first control pressure is reached, the continued inflation of the clutch is not dependent upon the position of the throttle lever.

When the air pressure within the clutch rises to a predetermined level, the control of these earlier patents pilot a governor valve which, in effect, connects the throttle lever control to the speed governor of the engine so that the pressure supplied to the governor directly corresponds to the position of the throttle lever and the engine speed is controlled by movement of the throttle lever. The throttle lever setting determines only the final operating speed and direction and all intermediate steps of clutch engagement and inflation, and engine governor speed are handled automatically by the control system.

Since the control systems of the prior art carry out their clutch and engine speed control in a sequential manner and the clutches are inflated to full inflation in a controlled manner through the programmed choke valve, there is a noticeable delay in response when the throttle lever is moved from neutral to a position for low speed. Such a condition is encountered during typical maneuvering. I have developed an improved control system which accomplishes rapid clutch engagement at low speeds to thereby provide a more rapid response during normal maneuvering of the vessel.

SUMMARY OF THE INVENTION

In accordance with the invention, there is provided a pneumatic clutch control system for controlling the inflation of a clutch which connects a prime mover to a propeller shaft and for controlling the speed of the prime mover, which control system includes first and second air branches each leading from a source of pressurized air to a master control valve which is shiftable to connect one or the other of the air branches to the clutch, the first air branch providing an air output to the master control valve that is responsive to air pressure supplied to it by a movable throttle, the second air branch including a boost valve which, when piloted, delivers pressure from the source to the clutch through the master control valve, and in which there is a maneuvering valve which pilots the boost valve when the throttle is set for low speed.

Further in accordance with the invention, there is provided such a control system in which the master control valve disconnects the first branch and connects the second branch to the clutch when such air output reaches a first control pressure, the second branch includes a choke valve adapted to continue the inflation of the clutch through the master control valve until the pressure within the clutch reaches a second control pressure, and the maneuvering valve is normally connected between the air source and the pilot on the boost valve but interrupts such connection when a speed pressure signal proportional to the air output rises to a predetermined level.

In the preferred form of the invention, there are both ahead and astern clutches for connecting the prime mover to the propeller shaft and initial movement of the throttle from a neutral position selects one or the other of the clutches, and the boost valve is alternately piloted by the maneuvering valve or by pressure within the selected clutch.

It is a principal object of the invention to provide a pneumatic clutch control system for a marine propulsion drive in which full clutch inflation is achieved rapidly at low vessel speed so as to result in enhanced maneuvering capabilities.

It is another object of the present invention to provide such a clutch control system which does not interfere with the normal operation of the clutch inflation when rapid change in direction or speed is commanded.

The foregoing and other objects and advantages will appear in the description which follows. In the description, reference is made to the accompanying drawing in which there is illustrated a preferred embodiment of the invention.

DESCRIPTION OF THE PREFERRED EMBODIMENT

Figure 1:
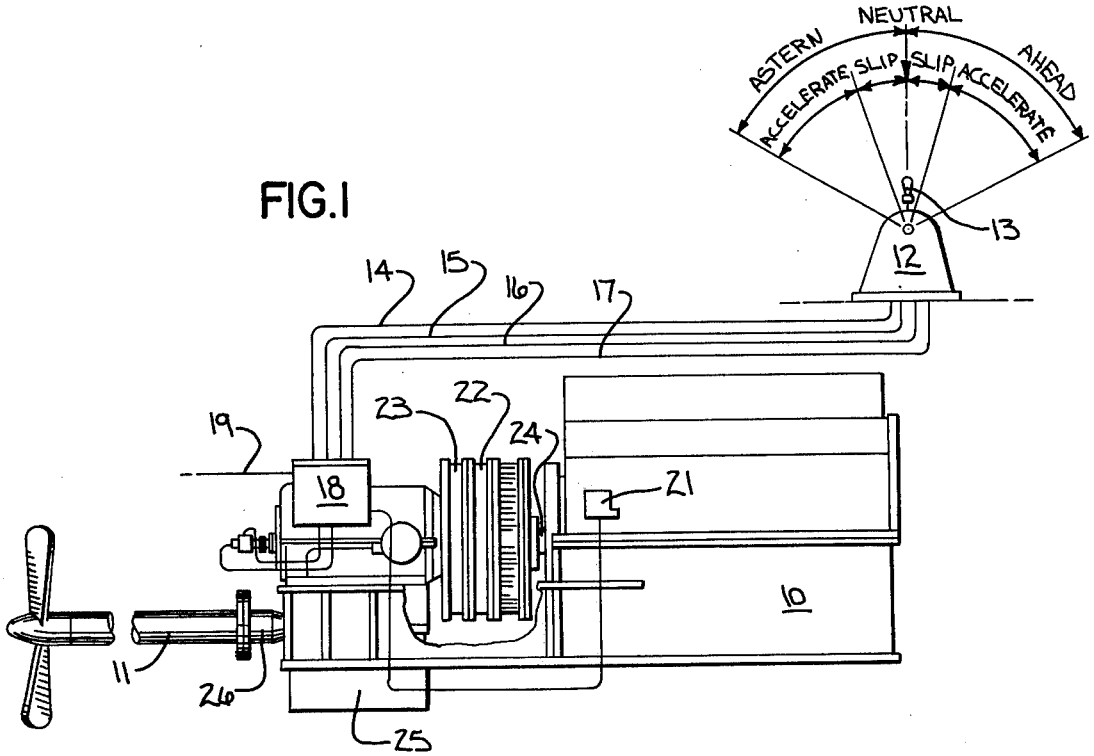
FIG. 1 is a schematic representation of a ship's propulsion system with which the improved control system of the present invention may be employed.

FIG. 1 illustrates a known arrangement of a pneumatically controlled marine propulsion system which controls the speed of the ship's engine 10 and its connection to the propeller shaft 11. The propulsion system includes a pilot house control stand 12 which mounts a throttle lever 13 controlling a throttle valve which connects four air lines 14, 15, 16 and 17 to a control panel assembly 18.

The control panel assembly 18 is connected to the ship's pressurized air source by a main supply line 19. The panel assembly 18, under control of the throttle lever 13, functions to regulate the supply of air through a line 20 to a throttle speed governor 21 for the engine 10 and also functions to control the supply of air to an ahead clutch 22 and an astern clutch 23. The clutches 22 and 23 act to transmit torque from the engine 10, through a drive shaft 24, to the input of a reverse reduction gear train 25 whose output shaft 26 is connected to the propeller shaft 11. The engine 10 is unidirectional and its output is high in speed but low in torque. The reverse reduction gear train 25 functions to reduce the rotational speed and to increase the torque, and also to reverse the direction of drive when required.

The throttle lever 13 is movable forwardly or rearwardly from a neutral position as indicated in FIG. 1 to select the ship's direction of travel. The amount of movement of the throttle lever 13 from neutral regulates the degree of clutch engagement and thereafter the engine speed.

Figure 2:
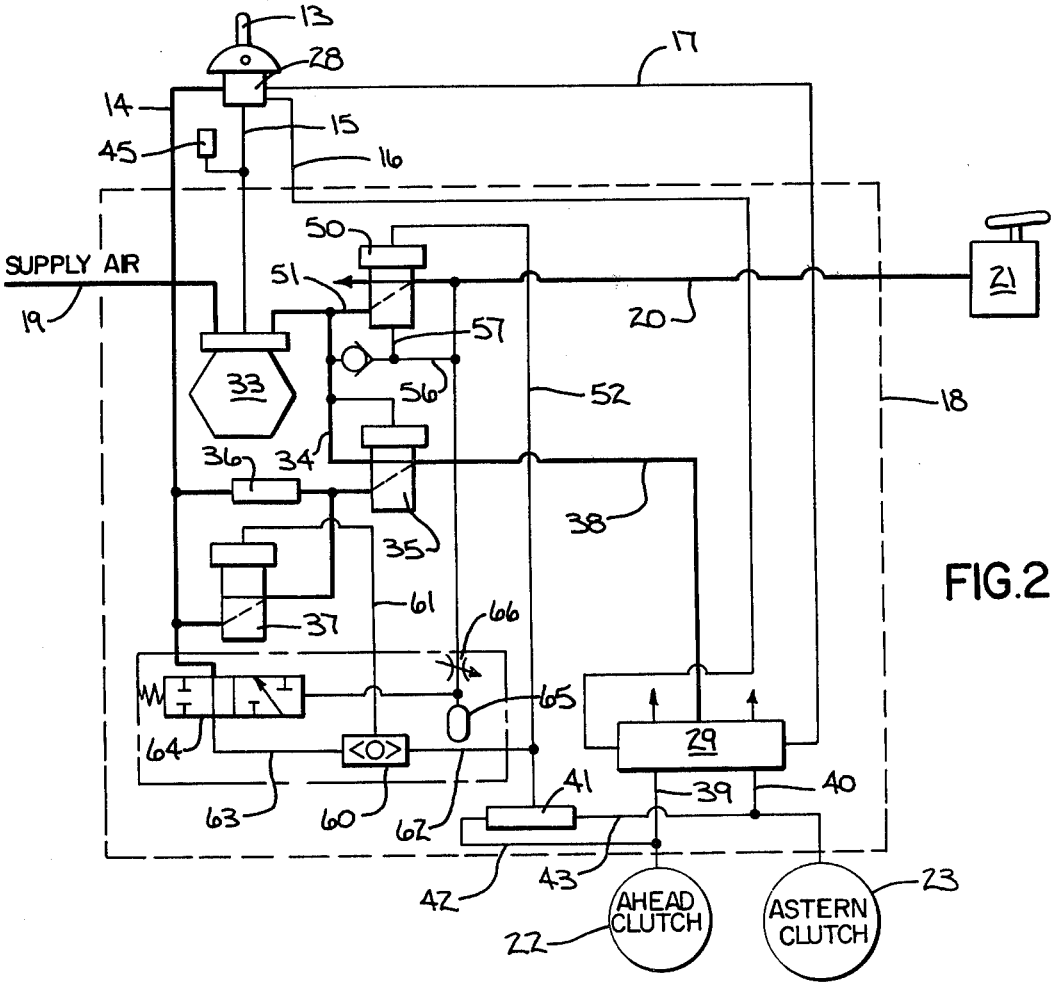
FIG. 2 is a schematic representation of the control system incorporating the present invention and connected to operate the propulsion system of FIG. 1.

Referring to FIG. 2, the throttle lever 13 directly controls a pressure control and directional flow control throttle valve 28. The throttle valve 28 is of known construction and is operative to furnish full supply air pressure from the supply line 14 which leads from the supply air line 19 to one or the other of the ahead and astern piloting air lines 16 and 17, respectively. The throttle valve 28 also supplies graduated pressure to the air line 15 and the graduated pressure is always proportional to the degree of movement of the lever 13 away from neutral.

If the lever 13 is pivoted at least five degrees forward or backward from its neutral position, the throttle valve 28 will connect the supply line 14 to the appropriate piloting air line 16 or 17. If the ahead piloting line 16 is selected, it operates directly to actuate a four-way selector valve 29 for selection of the ahead clutch 22. Similarly, if the astern piloting valve is selected, the four-way selector valve will be shifted to select the astern clutch 23. The initial movement to select the clutch for the desired direction of movement is not sufficient to cause engagement of the selected clutch, even through the clutch selector valve 29 is immediately actuated. Once past the initial movement from the neutral position, the propulsion system either begins to be engaged or can be placed in a slip condition in which there is insufficient air in the selected clutch to prevent clutch slippage even when the ship's engine 10 is operating at idle throttle speed. Special clutches with forced air cooling are required if the control system is to operate in a slip mode.

The speed signal line 15, whose air pressure is proportional to lever position, leads to the pilot port of a relay valve 33 whose inlet port is connected to the supply air line 19 and whose outlet port is connected by a line 34 to the inlet port of a master control valve 35. The relay valve 33 will relay or repeat large quantities of supply air from the supply line 19 to the line 34 at a pressure level which is the same as the air pressure in the speed signal line 15. The relay valve 33 and its connection to the supply air line 19 and master control valve 35 constitute a first air branch.

The master control valve 35 has a second inlet port which is connected to a second air branch leading from the air supply line 19. The second branch includes a choke valve 36 and a boost valve 37 connected in parallel across the supply air line 19 and the second inlet port of the master control valve 35.

An outlet port of the master control valve 35 connects to a third air branch which comprises an operating line 38 connected to the inlet port of the clutch selector valve 29. The clutch selector valve 29 has a pair of outlet ports connected by the operating lines 39 and 40 to the ahead clutch 22 and astern clutch 23, respectively.

After the throttle lever 13 has been moved about five degrees forwardly or rearwardly of its neutral position, air under pressure will pass through the master control valve 35 and the clutch selector valve 29 to begin to inflate the selected clutch 22 or 23. During the inflation of one of the clutches, the other clutch will be deflated through its corresponding exhaust port in the clutch selector valve 29. When the control lever 13 is in its neutral position, both clutches 22 and 23 are exhausted to the atmosphere through their respective exhaust ports.

The master control valve 35 is a pneumatic-piloted, pressure sensitive valve that changes the air passages within itself when air at a first control pressure, or higher, is supplied to its pilot port. The pilot port is coupled to the operating line 34 which is also connected to the first inlet port of the master control valve 35. Thus, air at the same pressure level is supplied to both the first inlet port and the pilot port of the master control valve 35 and this pressure is at the same level as that supplied to the relay valve 33 by the line 15 and is representative of the position of the throttle lever 13. So long as the pressure supply through the operating line 34 is less than a first control pressure which is the piloting pressure for the master control valve, that pressure supply will be directed through the master control valve 35 to the operating line 38 and thence to the selected clutch 22 or 23.

When the throttle lever 13 is moved to a position from neutral such that the first control pressure for the master control valve 35 is exceeded, the master control valve 35 will disconnect the first air branch from the clutches and will instead connect the second air branch to the clutch being controlled. At first the choke valve 36 will function to permit air to flow from the supply air line 19 through the master control valve 35 and to the operating line 38 at a programmed rate that is determined by the size of the choke valve 36. As a result, the clutch is not abruptly fully inflated.

In the control systems of the prior art Phinney patents, there is no flow of air through the boost valve 37 at this time because the boost valve 37 is normally closed and will not open until piloted by the air pressure within the clutch being inflated. The piloting of the boost valve 37 was provided by a clutch inflation shuttle valve 41 which has a pair of inlet ports connected by lines 42 and 43 to the operating lines 39 and 40 for the ahead and astern clutches 22 and 23, respectively.

The outlet of the clutch inflation shuttle valve 41 was connected by a piloting line directly to the pilot port of the boost valve 37. When the air pressure within the inflating clutch reached a second control pressure at which the boost valve 37 was set to be piloted, that valve opened to connect the supply air line 19 to the second inlet port of the master control valve 35 thereby bypassing the choke valve 36 and supplying full supply air pressure to the selected clutch. To deflate a clutch, the throttle lever 13 is returned to its neutral position which will cause the clutch selector valve 29 to connect the exhaust ports to the clutches 22 and 23. A bleeder valve 45 is installed to eliminate hysteresis between supply and exhaust portions of the throttle valve 28 under low pressure conditions.

The control panel assembly 18 controls the throttle speed governor 21 by means of a double-piloted throttle governor valve 50. The throttle governor valve 50 has an inlet connected by a line 51 to the operating line 34 leading from the outlet of the relay valve 33. An outlet port of the throttle governor valve 50 is connected to the operating line 20 for the throttle speed governor 21. The governor valve 50 has a first pilot port connected by a pilot line 52 to the outlet of the clutch inflation shuttle valve 41. The governor valve 50 is provided with an air pressure signal indicative of the speed at which the engine is to run following engagement of the selected clutch.

The purpose and operation of the governor valve 50 is fully described in U.S. Pat. No. 4,072,221.

Briefly stated, the throttle governor valve 50 controls the speed signal which is imposed upon the throttle speed governor 21 through the line 20 and it will prevent the speed signal from being transmitted at a level which exceeds the clutch capacity under situations where supply air pressure is lost or diminished for any reasons such as dirt or contaminations in the line, or a leak.

If the piloting pressure in the line 52 leading from the clutch inflation shuttle valve 41 is sufficient to initially overcome the force of a biasing spring within the governor valve 50, an exhaust valve within the governor valve 50 will first be closed and thereafter the inlet connected to the line 51 will be opened to the outlet leading to the line 20. The throttle governor valve 50 will then be open and an air pressure signal proportional to the position of the throttle lever 13 will pass from the inlet to the outlet and thence to the engine speed governor 21. In this manner engine speed will be controlled by varying the throttle lever position to vary the air pressure signal.

Once the governor valve 50 has been opened, a counter biasing piloting pressure is exerted on the valve which is added to the force of the internal spring which must be overcome by the piloting pressure. This reverse bias pressure is equal to the air pressure which is being transmitted through the governor valve 50 to the throttle speed governor 21 and is directed on a second piloting port through lines 56 and 57 which lead from the outlet line 20 of the governor valve 50. Thus, once the governor valve 50 has opened, the actual air pressure within the selected clutch as transmitted through the clutch inflation shuttle valve 41 must exceed the governor signal pressure plus the force of the governor valve spring. If the supply air pressure is lost or diminished, the maximum governor signal which is allowed to be transmitted to the operating line 20 will be reduced in proportion to the falling clutch pressure.

The operation and control described thus far does not differ from the controls previously known. The system in accordance with the present invention alters the prior art control by adding the elements and connections enclosed within the phantom lines in FIG. 2. Specifically, a three-port maneuvering shuttle valve 60 has its outlet port connected by a line 61 to the pilot of the boost valve 37. One inlet of the shuttle valve 60 is connected by a line 62 to the outlet port of the clutch shuttle valve 41. The second inlet to the maneuvering shuttle valve 60 is connected by a line 63 to one side of a two-way, two-position maneuvering valve 64, the other side of which is connected to the supply air line 19. The maneuvering valve 64 is spring biased to a normal operating position in which the maneuvering valve 64 completes a connection between the supply line 19 and the one inlet of the shuttle valve 60. The full supply air pressure imposed on the shuttle valve 60 will never be less than the pressure within a clutch which is imposed on the other inlet of the shuttle valve 60 from the clutch shuttle valve 41. Therefore, when the maneuvering valve 64 is in its normal position, the pilot line 61 to the boost valve 37 will be subjected to full supply air pressure thereby piloting the boost valve 37 so that the boost valve, rather than the choke valve 36, will control the delivery of air to the clutches from the second air branch. The maneuvering valve 64 is piloted to its alternate position, in which the inlet line 63 is exhausted, by pressure accumulating in an accumulator 65 which is fed through an adjustable choke valve 66 by a speed air pressure signal imposed on the line 20 by the governor throttle valve 50. That speed signal is proportional to the position of the throttle handle 13.

The operation of the maneuvering valve 63 and its associated elements and connections will be described in relation to a typical system which utilizes controlled slippage clutches. In such a typical system, the master control valve 35 may be shifted to connect the second branch of the air supply to the selected clutches at a first control pressure of 30 PSI. At pressures lower than that, the first air branch is connected to the selected clutch through the master control valve 35. The second control pressure at which the boost valve 37 is piloted may be 70 PSI. Without the maneuvering valve 37, the choke valve 36 would control at air outputs between 30 and 70 PSI. In the present control system, if the throttle lever 13 is moved from neutral to a low speed position, a clutch will first be selected. Thereafter the air output of the relay valve 33 to the first air branch 34 will increase until the air output of the relay valve 33 increases to 30 PSI. At that time, the master control valve 35 will shift to connect the second air branch and full air source pressure of 140 PSI will be supplied through the already piloted boost valve 37 to immediately inflate the valve and thereby give control to the operator. At the same time, the governor valve 50 will be piloted to begin to pass the air output of the relay valve 33 to the line 20 as a speed signal.

As the speed signal is supplied to the line 20, the accumulator 65 is pressurized through the choke valve 66 at a rate proportional to the increase in vessel velocity. When the accumulator pressure reaches 45 PSI (corresponding to approximately ⅓ full vessel velocity) the maneuvering valve 64 is shifted. This exhausts the signal to the shuttle valve 60 thereby allowing the shuttle valve 60 to transmit the clutch pressure to the pilot of the boost valve 37. This results in normal control operation during maneuvering, with the inflation of the clutches thereafter controlled by the choke valve 36 until the clutch pressure reaches 70 PSI at which time the boost valve 37 is again piloted and bypasses the inflation choke valve 36.

If a sudden increase to a high speed is required from zero speed, or if a "crash" reversal of direction is required, the maneuvering valve 64 is rendered ineffective since the speed signal pressure will rise rapidly from the first control pressure (30 PSI in this example) to the piloting pressure for the maneuvering valve 64 (45 PSI). During this time the piloting pressure for the maneuvering valve 64 supplied by the accumulator 65 will change very slowly due to the restriction of the choke valve 66. Thus, the maneuvering valve will not actuate during such a maneuver.

I claim:

1. A pneumatic clutch control system for a marine propulsion drive including a prime mover controlled by a throttle speed governor, a drive train for transmitting power from the prime mover to a propeller drive shaft, an air inflatable clutch for connecting the prime mover to said drive train, and throttle means for actuation of the propulsion system, said control system being adapted for connection to a source of pressurized air and comprising:

first and second air branches each leading from said air sourse to a master control valve which is shiftable to connect one or the other of said air branches to said clutch;

said first air branch including means operatively connected to said throttle means to provide an air output that is responsive to air pressure supplied to said first branch by said throttle means;

said master control valve being responsive to the air output from said first branch to disconnect said first branch and connect said second branch to said clutch when said air output reaches a first control pressure;

a throttle governor control means connected to receive the air output of said first air branch and for providing a speed pressure signal to said throttle speed governor which is proportional to said air output; and said second air branching including a choke valve connected between said air source and said master control valve and adapted to continue the inflation of said clutch through said master control valve until the pressure within said clutch reaches a second control pressure, a piloted boost valve connected between said air source and said master control valve in parallel with said choke valve, said boost valve being normally closed but adapted when piloted at said second control pressure to connect the source of pressurized air directly to the clutch through said master control valve, and a maneuvering valve disposed in the connection between said air source and the pilot of said boost valve, said maneuvering valve normally completing the connection between said air source and the pilot of said boost valve but being shifted to disrupt the connection after the speed pressure signal rises to a predetermined level.

2. A control system in accordance with claim 1 wherein said maneuvering valve is connected between said air source and one inlet of a shuttle valve whose other inlet is connected to said clutch, and whose outlet is connected to the pilot of said boost valve.

3. A control system in accordance with claim 2 wherein said maneuvering valve is a two-position valve which is spring biased to its normal position and which is piloted to a second position exhausting to the atmosphere by the pressure within an accumulator which is connected to accumulate said speed pressure signal.

4. In a pneumatic clutch control system for a marine propulsion system having a prime mover controlled by a throttle speed governor, a drive train for transmitting power from the prime mover to a propeller drive shaft, ahead and astern air inflatable clutches for selectively connecting the prime mover to said drive train, and throttle means for actuation of the propulsion system, and wherein said control system is adapted for connection to a source of pressurized air and includes a selector valve responsive to movement of the throttle means from neutral to select one or the other of said ahead and astern clutches, inflation means for said clutches including first and second air branches from the air source to a master control valve which is shiftable to connect an air branch to the selected clutch, the first branch including means operatively connected to the throttle means to provide an air output that is proportional to movement of the throttle means from neutral up to a first control pressure, the second branch including a piloted boost valve connected between said air source and said master control, and which, when piloted, delivers full pressure from the source to the selected clutch through said master control valve, the combination therewith of:

a shuttle valve having its outlet connected to the pilot of the boost valve and one inlet connected to the selected clutch; and a piloted maneuvering valve normally connecting said air source to the other inlet of said shuttle valve and adapted to be piloted to shift said maneuvering valve to interrupt that connection after the air output proportional to throttle position has risen beyond a predetermined level.

5. A control system in accordance with claim 4 wherein there is a throttle governor control means connected to receive the air output of the first branch and for providing a speed pressure signal to said throttle speed governor that is proportional to said air output, together with an accumulator connected to receive said speed pressure signal and the pilot of said maneuvering valve is connected to said accumulator to be piloted by the accumulated speed pressure signal.

* * * * *